US011480043B2

(12) United States Patent
Rodrigues et al.

(10) Patent No.: US 11,480,043 B2
(45) Date of Patent: Oct. 25, 2022

(54) SYSTEM AND METHOD FOR HYDRAULICALLY DRIVEN UNDERWATER PUMPING

(71) Applicant: PETRÓLEO BRASILEIRO S.A.—PETROBRAS, Rio de Janeiro (BR)

(72) Inventors: Roberto Rodrigues, Rio de Janeiro (BR); Carlos Alberto Bandeira Riberio Cardoso, Rio de Janeiro (BR); Tatiane Silva Vieira, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 88 days.

(21) Appl. No.: 16/635,448

(22) PCT Filed: May 3, 2018

(86) PCT No.: PCT/GB2018/051189
§ 371 (c)(1),
(2) Date: Jan. 30, 2020

(87) PCT Pub. No.: WO2018/203070
PCT Pub. Date: Nov. 8, 2018

(65) Prior Publication Data

US 2020/0240253 A1 Jul. 30, 2020

(30) Foreign Application Priority Data

May 3, 2017 (BR) ..... 102017009298-4

(51) Int. Cl.
*E21B 43/36* (2006.01)
*E21B 43/01* (2006.01)
(Continued)

(52) U.S. Cl.
CPC ..... *E21B 43/36* (2013.01); *E21B 43/01* (2013.01); *E21B 41/0007* (2013.01);
(Continued)

(58) Field of Classification Search
None
See application file for complete search history.

(56) References Cited

U.S. PATENT DOCUMENTS 6,412,562 B1 * 7/2002 Shaw ..... F04D 13/10 166/335
7,314,084 B2 * 1/2008 Rodrigues ..... E21B 33/038 166/344
(Continued)

FOREIGN PATENT DOCUMENTS

BR 0113728 A 9/2003
WO 2011/057369 A1 5/2011

OTHER PUBLICATIONS

International Search Report issued in International Application No. PCT/GB2018/051189, dated Jul. 10, 2018 (4 pages).
(Continued)

*Primary Examiner* — Matthew Troutman
*Assistant Examiner* — Douglas S Wood
(74) *Attorney, Agent, or Firm* — Osha Bergman Watanabe & Burton LLP

(57) ABSTRACT

A hydraulically driven underwater pumping system may include a pumping module connected to a subsea base. The subsea base may be connected to: a subsea producing well via a production line that carries the fluid produced by the subsea producing well; and a production unit via a riser and a service line. The hydraulically driven underwater pumping system may receive working fluid from the production unit via the service line. Additionally, a pump, located in the pumping module, may be driven hydraulically by the work-
(Continued)

ing fluid and pump the fluid produced by the subsea producing well to the production unit. The hydraulically driven underwater pumping system may mix the working fluid, after being used to drive the pump, with the fluid produced by the subsea producing well that is pumped to the production unit.

12 Claims, 8 Drawing Sheets

(51) Int. Cl.
*E21B 41/00* (2006.01)
*E21B 43/12* (2006.01)

(52) U.S. Cl.
CPC ..... *E21B 43/122* (2013.01); *E21B 43/124* (2013.01); *E21B 43/129* (2013.01)

(56) References Cited

U.S. PATENT DOCUMENTS 7,422,066 B2 * 9/2008 Rodrigues ..... E21B 43/01 166/85.1
7,516,795 B2 * 4/2009 Lopes Euphemio ... E21B 43/01 166/268
8,857,519 B2 * 10/2014 Hale ..... E21B 43/017 166/338
2006/0118310 A1 * 6/2006 Euphemio ..... E21B 43/121 166/368
2008/0282776 A1 * 11/2008 Loeb ..... F04B 17/03 73/49.5
2010/0212492 A1 * 8/2010 Miotto ..... B01D 19/0042 96/174
2011/0042093 A1 * 2/2011 Rodrigues ..... E21B 43/129 166/344
2011/0155385 A1 * 6/2011 Haheim ..... E21B 43/01 166/357
2011/0158824 A1 * 6/2011 Wright ..... F04C 2/16 417/375
2011/0232912 A1 * 9/2011 Close ..... E21B 43/01 166/357
2013/0195684 A1 * 8/2013 Wilson ..... F04B 23/00 417/53
2016/0279684 A1 * 9/2016 Lund ..... B08B 9/027
2021/0246752 A1 * 8/2021 Osthus ..... E21B 41/0007

OTHER PUBLICATIONS

Written Opinion issued in International Application No. PCT/GB2018/051189, dated Jul. 10, 2018 (6 pages).

* cited by examiner

SYSTEM AND METHOD FOR HYDRAULICALLY DRIVEN UNDERWATER PUMPING

CROSS-REFERENCE TO RELATED APPLICATION

This application claims the benefit of priority to BR 10 2017 009298-4, filed 3 May 2017, which is incorporated herein by reference in its entirety.

FIELD OF THE INVENTION

The present invention relates to systems for artificial lifting and for ensuring production flow from subsea oil wells.

BACKGROUND OF THE INVENTION

During offshore oil production, especially in deep waters, various systems and equipment have been developed for supplying energy to the oil, both in the form of pressure and in the form of heat, with the aim of facilitating its flow to the surface.

The use of pumps inside oil wells makes it possible, when applicable, to increase the production of the well. However, this equipment has a relatively high failure rate, with an average of one failure every two years for submerged centrifugal pumps (SCP), the commonest type.

Faults in wet-completion subsea wells require expensive maintenance work, since it is necessary to (i) stop production, (ii) withdraw the production casing and the respective pump and (iii) use an offshore sonde. In many cases the high costs represent an obstacle to the economic feasibility of production development projects.

Various alternatives have been proposed for overcoming this problem. At present, for subsea wells, provided the conditions of pressure and amount of free gas are favourable, pumps are installed, preferably away from the producing well, on the sea floor. This configuration facilitates pump installation and possible replacement in case of failure. Examples of this practice are described in patent documents U.S. Pat. Nos. 7,314,084 and 7,516,795, where pumps of the SCP type driven by an electric motor are installed away from the producing well.

In order to generate large flow rates and large pressure differences, these pumps are very long, of the order of 25 to 40 metres, which results in pumping modules of great length and weight, handling of which is only possible by means of sondes or special vessels, which are expensive, critical naval resources.

Some embodiments have been proposed for implementing solutions for pump installation and withdrawal from the production unit itself, dispensing with the use of other naval resources, which are not always promptly available. One example is patent document PI0113728-0, which proposes installation of an SCP above a wet Christmas tree (wet tree) and descent inside a riser. In the proposed configuration, it is necessary and obligatory for the riser to be vertical, i.e. without curvature, and to have a system for compensating movements, making application thereof difficult in production units of the FPSO (Floating Production Storage and Offloading) type.

Moreover, in document U.S. Pat. No. 8,857,519, a method is proposed for modernizing production systems, popularly known as retrofitting, where systems for underwater separation and pumping with electric drive may be installed and lowered through production risers.

Thus, despite the merits of the various existing techniques for installing pumps on the sea floor, no solution has been presented that involves both reduction of the length of the modules and consequent reduction of the difficulty of installation and handling thereof plus, if necessary, reduction of the viscosity of heavy oils to prevent any obstruction.

As will be explained in greater detail below, the present disclosure addresses the problems described above in a practical and efficient manner.

SUMMARY OF THE INVENTION

The present disclosure provides a system and a method for hydraulically driven pumping, dispensing with the use of underwater electric motors.

A further aim of the present disclosure is to provide a system and a method of pumping that efficiently prevent the formation of hydrates and paraffin deposition in risers.

A further aim of the present disclosure is to provide a pumping system of relatively reduced size compared to the conventional pumping systems, facilitating their construction, transport, installation and maintenance.

Thus, to achieve these aims, according to a first aspect, the present disclosure provides a hydraulically driven underwater pumping system, comprising a pumping module connected to a subsea base, wherein the subsea base is connected to: a subsea producing well via a production line that carries the fluid produced by the subsea producing well; and a production unit via a riser and a service line, and wherein the system is configured to receive working fluid from the production unit by means of the service line, the system further comprising a pump, located in the pumping module, that is configured to be driven hydraulically by the working fluid and is configured to pump the fluid produced by the subsea producing well to the production unit; and wherein the system is further configured to mix the working fluid, after it has been used to drive the pump, with the fluid produced by the subsea producing well that is pumped to the production unit.

The pump can be of the centrifugal type or jet type. The pumping module can comprise a suction line and a discharge line connected to the pump.

Two or more pumps may be located in the pumping module.

The pumping module can be connected to the subsea base via a connector. The connector can be separable into two parts.

The system can comprise at least one blocking valve.

The pumping module can comprise a gas lift mandrel.

The pumping module can comprise a heating element configured to heat the fluid pumped to the production unit.

The working fluid can pre-heated in the production unit, or in the pumping module, or in both.

According to a second aspect, there is provided a method for hydraulically driven underwater pumping, wherein the method comprises the steps of: hydraulically driving a pump housed in a pumping module, by means of a working fluid received from a production unit via a service line; pumping, by means of the pumping module, fluid produced by a subsea producing well to the production unit via a riser; and mixing and discharging, in the pumping module, the working fluid with the fluid produced by the subsea producing well.

The pumping module can be recoverable and be connected to a subsea base, which in its turn is connected to: the subsea producing well via a production line; and the production unit via the riser and the service line. The pumping module can be connected to the subsea base by means of a connector.

The method can further comprise a step of pre-heating the working fluid in the production unit or in the pumping module, or in both.

The method can further comprise a step of heating, in the pumping module, the mixture of working fluid and fluid produced by the subsea producing well.

In the system of the first aspect or the method of the second aspect, the pumping module optionally does not comprise an electric motor.

In the system of the first aspect or the method of the second aspect, the working fluid optionally comprises water.

In the system of the first aspect or the method of the second aspect, the riser optionally does not comprise production casings or power cables within the riser.

According to another aspect, there is a hydraulically driven underwater pumping system, comprising a recoverable pumping module connected to a subsea base which in its turn is connected to at least one subsea producing well by at least one production line and an annulus line. The subsea base is also connected to a production unit via a riser and a service line. A working fluid, optionally heated, obtained from the production unit, via a service line, provides the hydraulic drive of a pump housed in the pumping module, subsequently being mixed and flowing together with the fluid produced to the production unit through at least one production line.

The present disclosure further provides a method for hydraulically driven underwater pumping, comprising the steps of (i) driving hydraulically a pump housed in the pumping module by means of a working fluid, optionally heated, received from a production unit via a service line, (ii) pumping the production fluid by means of the pumping module, (iii) mixing and discharging, in the pumping module, the working fluid with production fluid through at least one production line.

According to another aspect, there is provided a hydraulically driven underwater pumping system, characterized in that it comprises a recoverable pumping module connected to a subsea base, which in its turn is connected to: at least one subsea producing well via at least one production line that carries the fluid produced and an annulus line; and a production unit via a riser and a service line, in which working fluid received from the production unit by means of the service line: drives hydraulically at least one pump located in the pumping module; and after driving the pump is mixed with the fluid produced flowing to the production unit.

The pumping module can comprise at least one hydraulically driven pump.

The hydraulically driven pump can be of the centrifugal type or jet type.

The pumping module can comprise a suction line and a discharge line connected to at least one hydraulically driven pump.

The pumping module can be connected to the subsea base via at least one connector. The at least one connector can be separable into two parts.

The system can comprise at least one blocking valve.

The pumping module can comprise at least one gas lift mandrel.

The pumping module can comprise at least one heating element.

The working fluid can be pre-heated in the production unit or in the pumping module by the heating element or in both.

According to another aspect there is provided a method for hydraulically driven underwater pumping, characterized in that it comprises the steps of: driving hydraulically at least one pump housed in a pumping module, by means of a working fluid received from a production unit via a service line; pumping, by means of the pumping module, the fluid produced to the production unit via at least one riser; and mixing and discharging, in the pumping module, the working fluid with the fluid produced received from at least one subsea producing well.

The pumping module can be recoverable and be connected to a subsea base, which in its turn is connected to: at least one subsea producing well via at least one production line and an annulus line; and a production unit via a riser and a service line.

The pumping module can be connected to the subsea base by means of at least one connector.

The working fluid can be pre-heated in the production unit or in the pumping module by the heating element or in both.

The system can comprise the additional step of heating the mixture of working fluid with fluid produced in the pumping module by means of at least one heating element.

BRIEF DESCRIPTION OF THE FIGURES

The detailed description presented hereunder refers to the appended figures and their respective reference numbers.

DETAILED DESCRIPTION OF THE INVENTION

First, it is emphasized that the following description will be of preferred embodiments, applied to an underwater pumping system connected to at least one subsea oil well and to a floating production unit, for example an FPSO.

As will be obvious to a person skilled in the art, the invention is not limited to these particular embodiments, but may also be applied to other types of production units, such as Spar, TLP, Semi-sub, etc.

Figure 1:
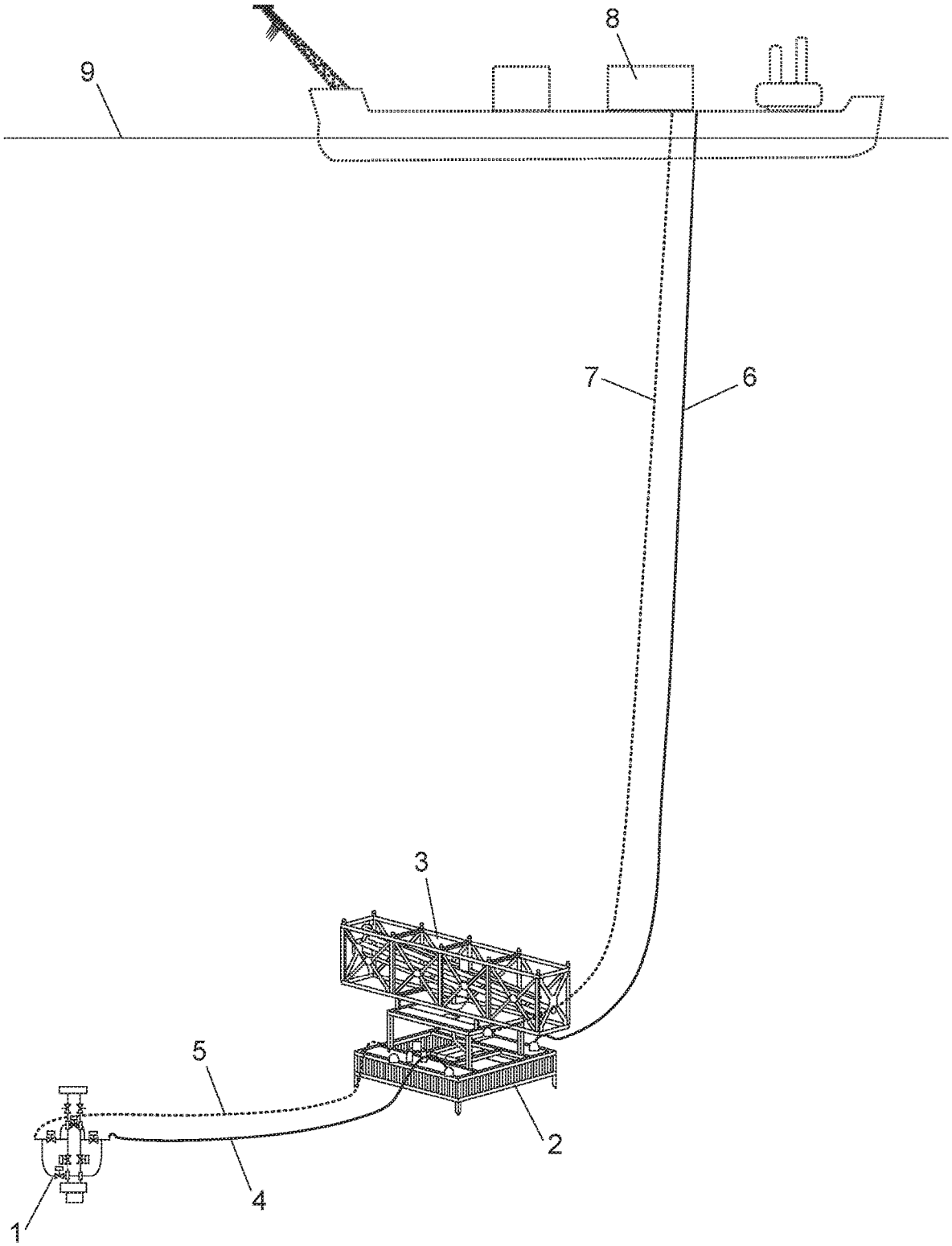
FIG. 1 illustrates schematically a preferred embodiment of a hydraulically driven underwater pumping.

In a first embodiment of an underwater pumping system, illustrated in the schematic view in FIG. 1, a hydraulically driven underwater pumping system is provided. The system comprises a subsea base 2, on which at least one recoverable pumping module 3 is supported and connected. In this context, "recoverable" means that the pumping module is designed to be connectable and disconnectable from the surrounding system.

The subsea base 2 is connected to at least one subsea producing well 1. The base 2 receives fluid produced by the well 1 via at least one production line 4 and an annulus line 5. The subsea base 2 is also connected hydraulically to a production unit 8. The connection is via a riser 6 and a service line 7.

The service line 7 can be used for supplying the pumping module 3 with working fluid or gas lift. The oil produced by the production line 4 can be aspirated by the pumping module 3 and then mixed with the working fluid discharged by a turbine 18 (see further description below) and sent to the production unit 8 via riser 6. Moreover, as illustrated in FIG. 1, the production unit 8 can be located on the surface of the sea 9.

Figure 2:
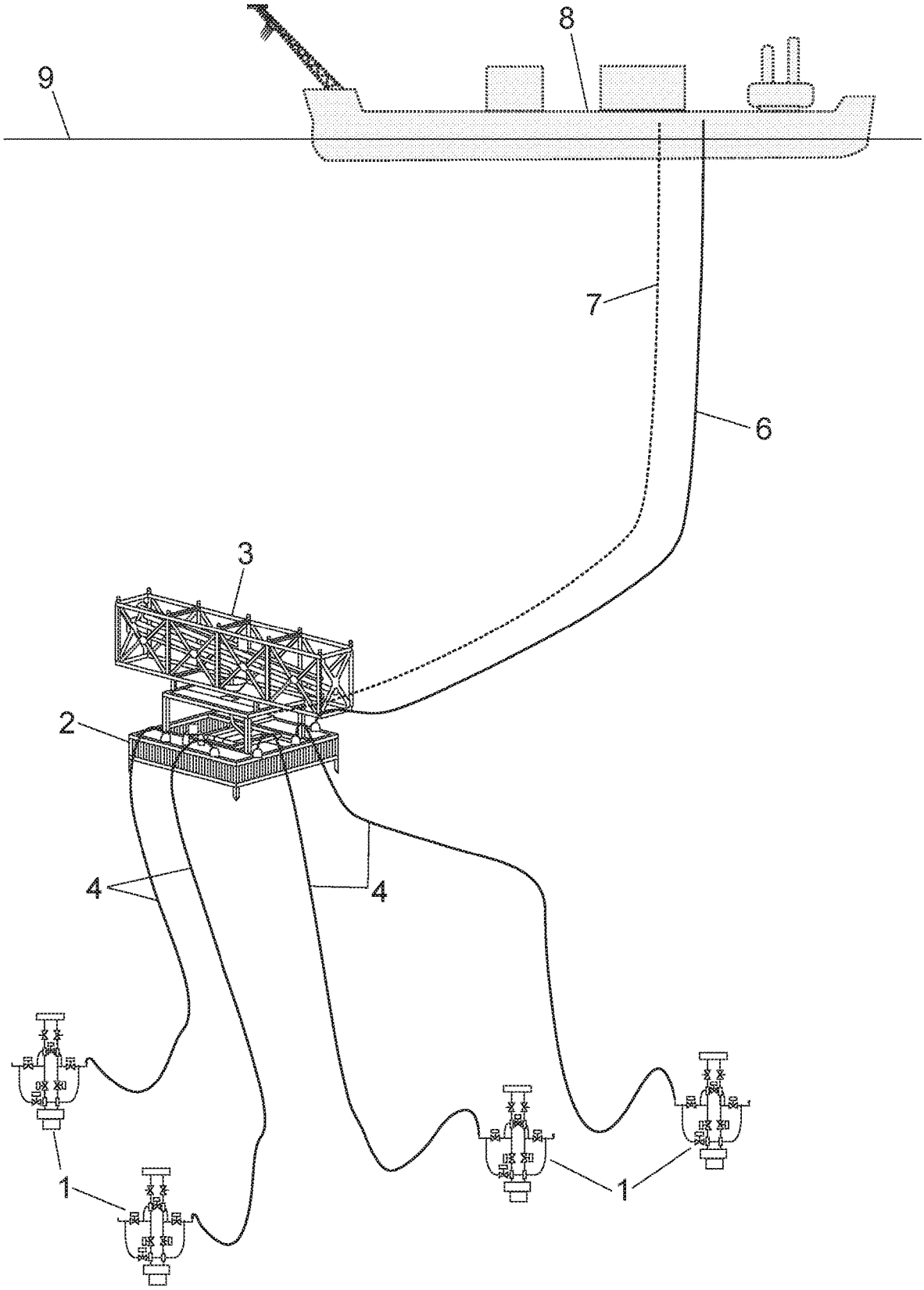
FIG. 2 illustrates schematically an alternative embodiment of the hydraulically driven underwater pumping.

In an alternative embodiment of an underwater pumping system, illustrated in FIG. 2, more than one subsea producing well 1 is connected to the pumping base 2 and consequently to the pumping module 3. As can be seen, an arrangement comprising four subsea producing wells 1 is shown in FIG. 2.

Figure 3:
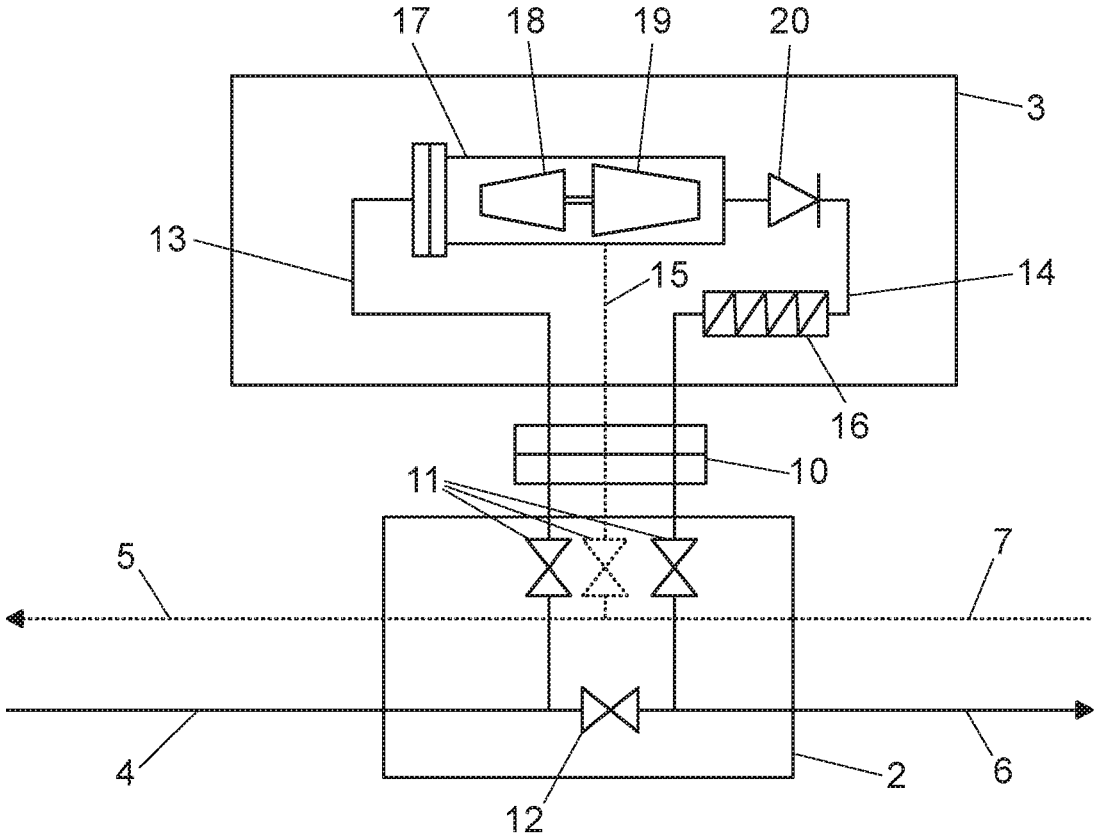
FIG. 3 illustrates schematically a hydraulically driven underwater pumping module according to a first embodiment.

FIG. 3 illustrates a first embodiment of a pumping module 3. In this embodiment, an HSP (Hydraulic Submersible Pump) is mounted in a capsule 17. The HSP consists of a centrifugal pump 19 driven by a turbine 18. The HSP is connected hydraulically to a suction line 13 and to a discharge line 14.

Optionally, a check valve 20 is provided in the discharge line 14 of the pumping module 3. Also optionally, a heating element 16 may be provided in the pumping module 3. As shown, the heating element 16 may be used to supply heat to the fluid produced. This may facilitate flow and reduce the risks of obstruction of the production line.

The pumping module 3 can be connected hydraulically to a subsea base 2 via at least one connector 10.

In operation, the fluid produced, received from the subsea producing well 1, reaches the subsea base 2 through the production line 4. In the embodiment of FIG. 3, the fluid produced is diverted to the suction line 13 of the pumping module 3, passing through the connector 10. The fluid produced is sucked in by the HSP and, after attaining the pressure of the centrifugal pump 19, is mixed with the working fluid of the discharge of the turbine 18.

The working fluid is received from the production unit 8 through the service line 7, and may be heated or may not be heated. The working fluid may be heated in the production unit 8 for example. Alternatively, the working fluid could be heated in the pumping module 3 by the heating element 16 (not shown in the depicted arrangement of FIG. 3). In another alternative, the working fluid could be pre-heated in the production unit 8 and also in the pumping module 3 by the heating element 16.

The working fluid received from the production unit 8 reaches the HSP through a working fluid line 15, after being diverted from the service line 7 by the subsea base 2. This working fluid has the functions of (i) providing hydraulic energy for operation of the turbine 18, which drives the centrifugal pump 19 of the HSP, and (ii) being mixed with the production fluid for pumping to the production unit 8, reducing its viscosity and optionally heating it.

Figure 4:
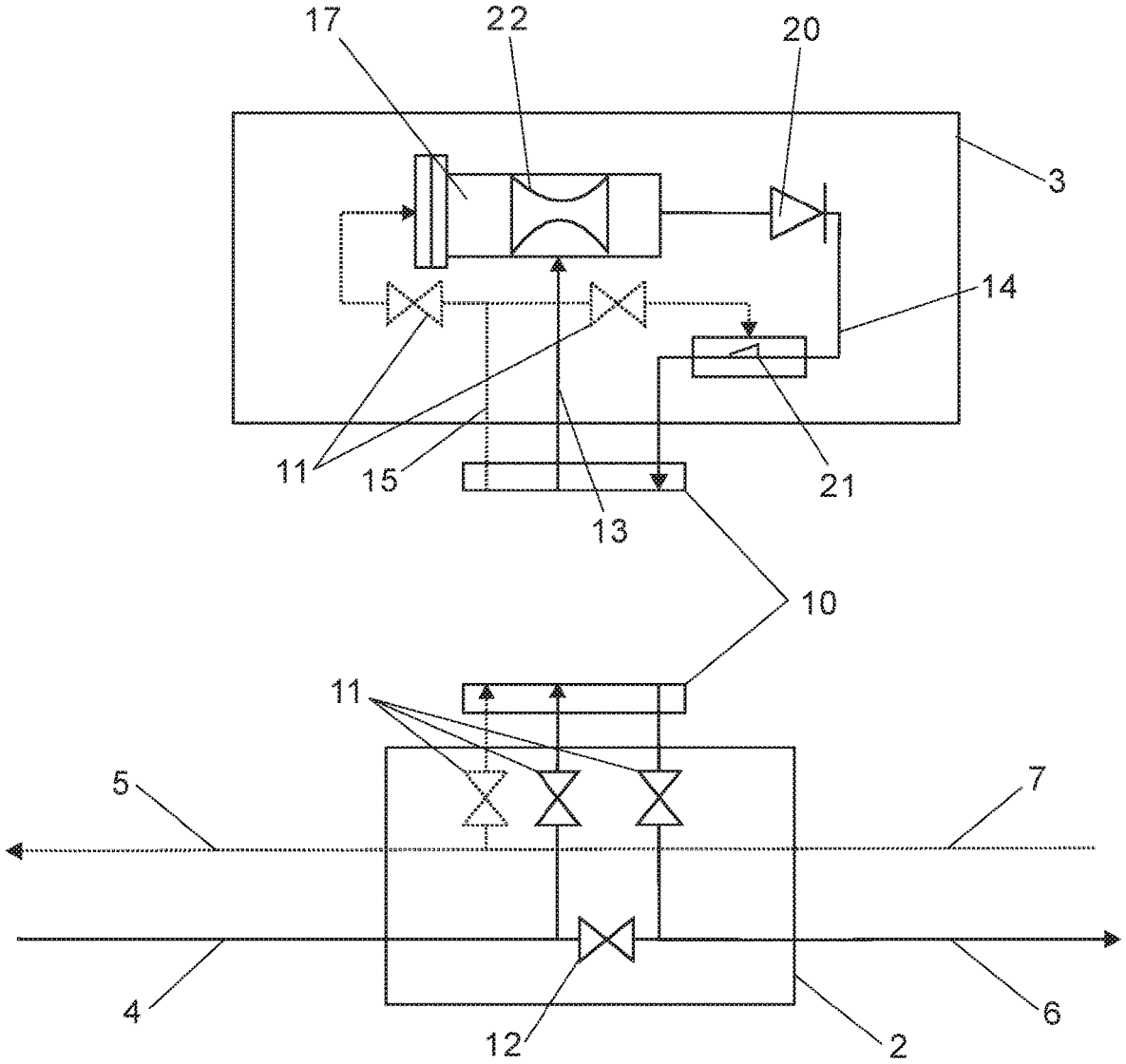
FIG. 4 illustrates schematically a hydraulically driven underwater pumping module according to a second embodiment.

In a second embodiment of a pumping module 3, illustrated in FIG. 4, the pumping module 3 comprises a jet pump 22 mounted in a capsule 17, replacing the HSP. Like the HSP of the first embodiment, the jet pump 22 is also driven hydraulically by means of the working fluid, which may be optionally heated in the production unit 8 and/or the pumping module 3. Optionally, a gas lift mandrel 21 may be integrated with the pumping module 3 in the discharge line 14. This confers greater operational flexibility, with gas lift as a lifting method alternative to pumping.

As in the first embodiment, in operation the fluid produced, received from the subsea producing well 1, reaches the subsea base 2 through the production line 4. As illustrated in FIG. 4, the fluid produced is diverted to the suction line 13 of the pumping module 3, passing through the connector 10. The fluid produced is sucked in by the jet pump 22 and, at it passes through it, is mixed with the working fluid (which may be heated) received from the production unit 8 through the service line 7.

Similarly, the working fluid received from the production unit 8 reaches the jet pump 22 via a working fluid line 15, after being diverted from the service line 7 by the subsea base 2.

Preferably, in any embodiment, the connector 10 is separable into two parts, as illustrated in FIG. 4. This contributes to the recoverability of the pumping module 3, meaning that the pumping module 3 can easily be removed for maintenance or replacement merely by separating the connector 10, disconnecting it from the subsea base 2.

Figure 5:
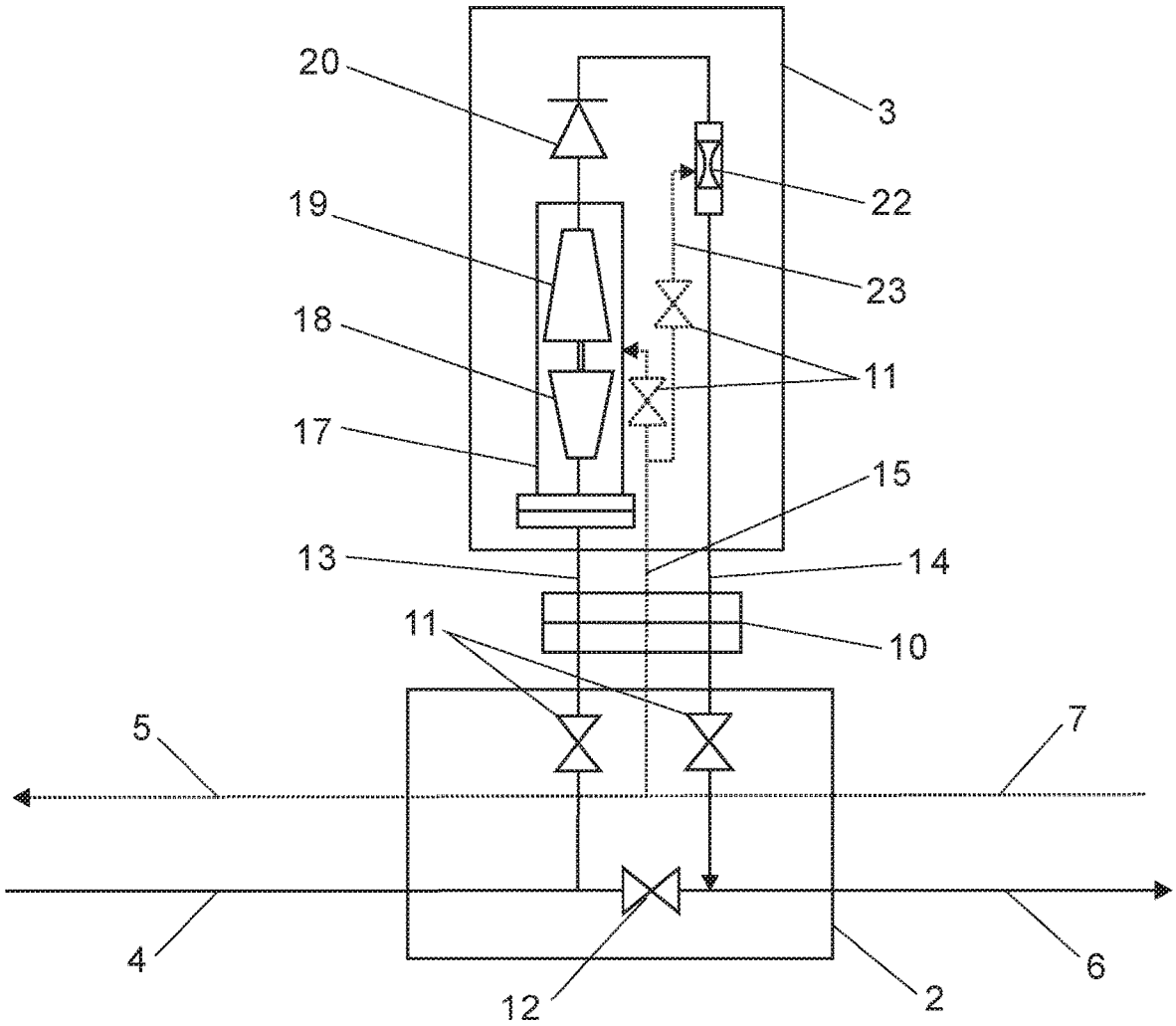
FIG. 5 illustrates schematically a hydraulically driven underwater pumping module according to a third embodiment.

FIG. 5 illustrates a third embodiment, which is a variant of the first embodiment illustrated in FIG. 3. In this embodiment, the pumping module 3 is arranged vertically relative to the subsea base 2.

Figure 6:
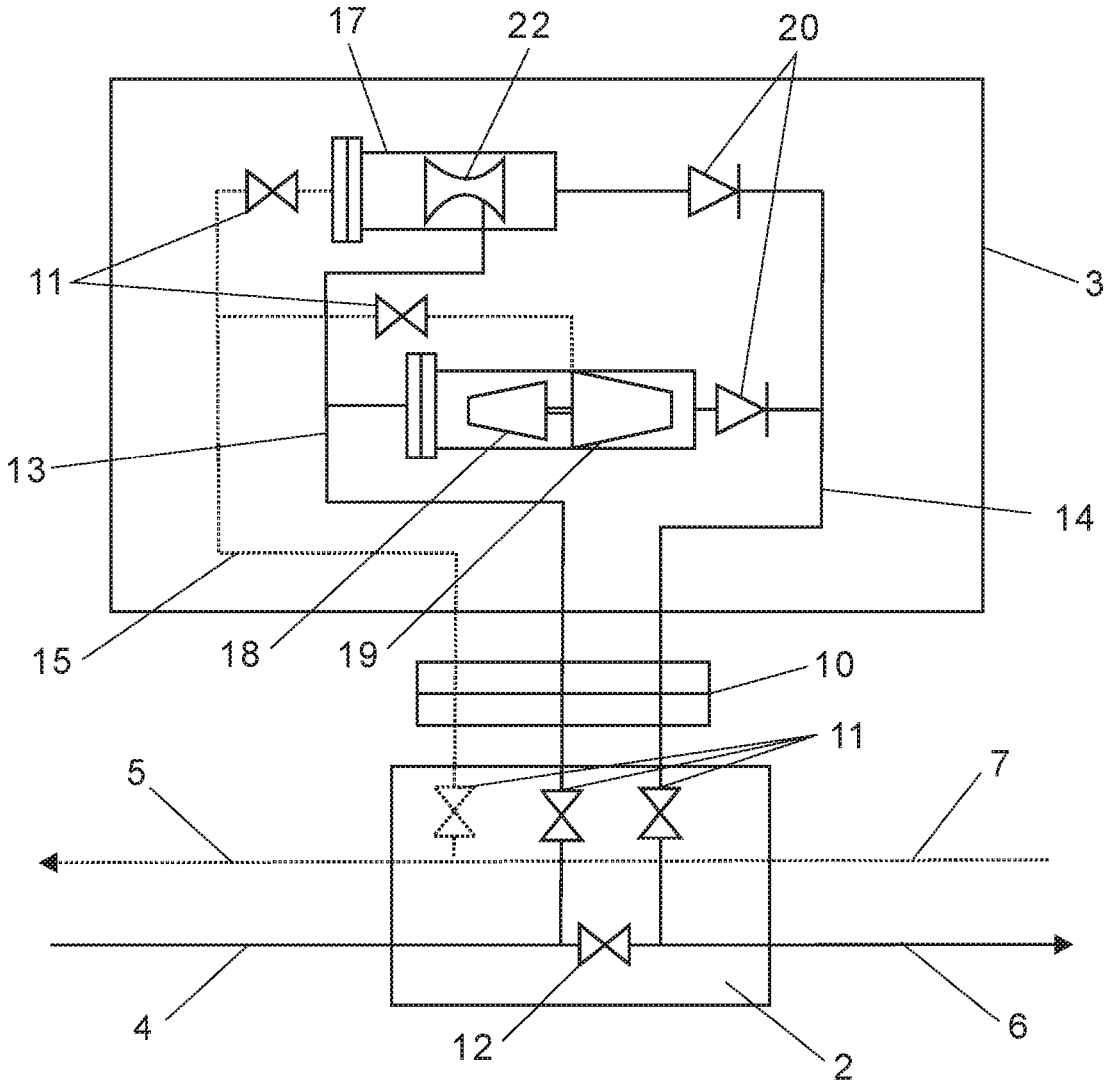
FIG. 6 illustrates schematically a hydraulically driven underwater pumping module according to a fourth embodiment.

FIG. 6 illustrates a fourth embodiment, which is another variant of the first embodiment illustrated in FIG. 3. In this embodiment, a jet pump 22 is combined with an HSP in parallel, in a horizontal arrangement, for the pumping module 3. In this embodiment, the pumps of different types can operate as reserves for one another in case of failure and/or stoppage for maintenance.

Figure 7:
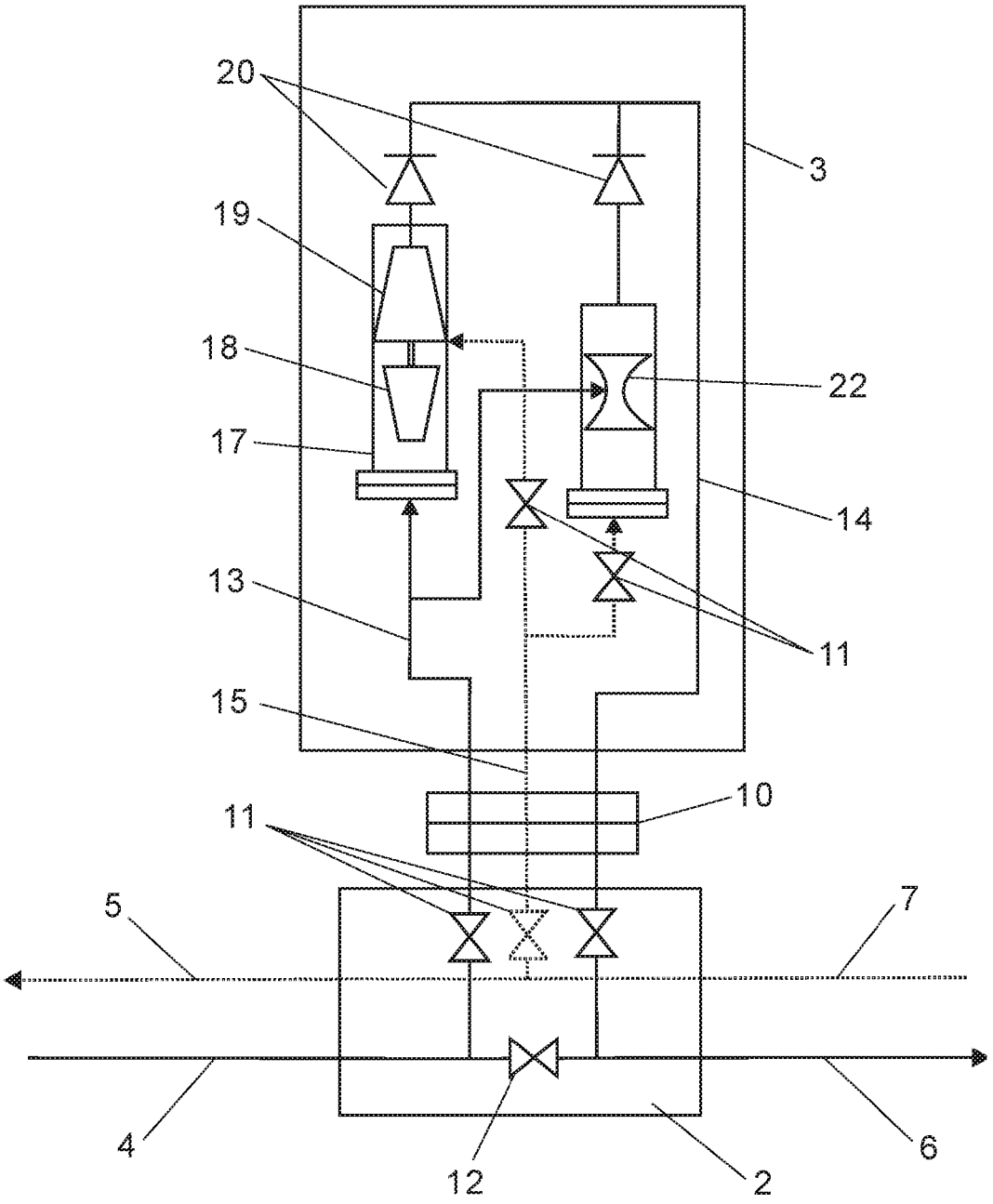
FIG. 7 illustrates schematically a hydraulically driven underwater pumping module according to a fifth embodiment.

FIG. 7 illustrates a fifth embodiment, which is a variant of the fourth embodiment illustrated in FIG. 6. In this embodiment, the pumping module 3 is arranged vertically relative to the subsea base 2.

Figure 8:
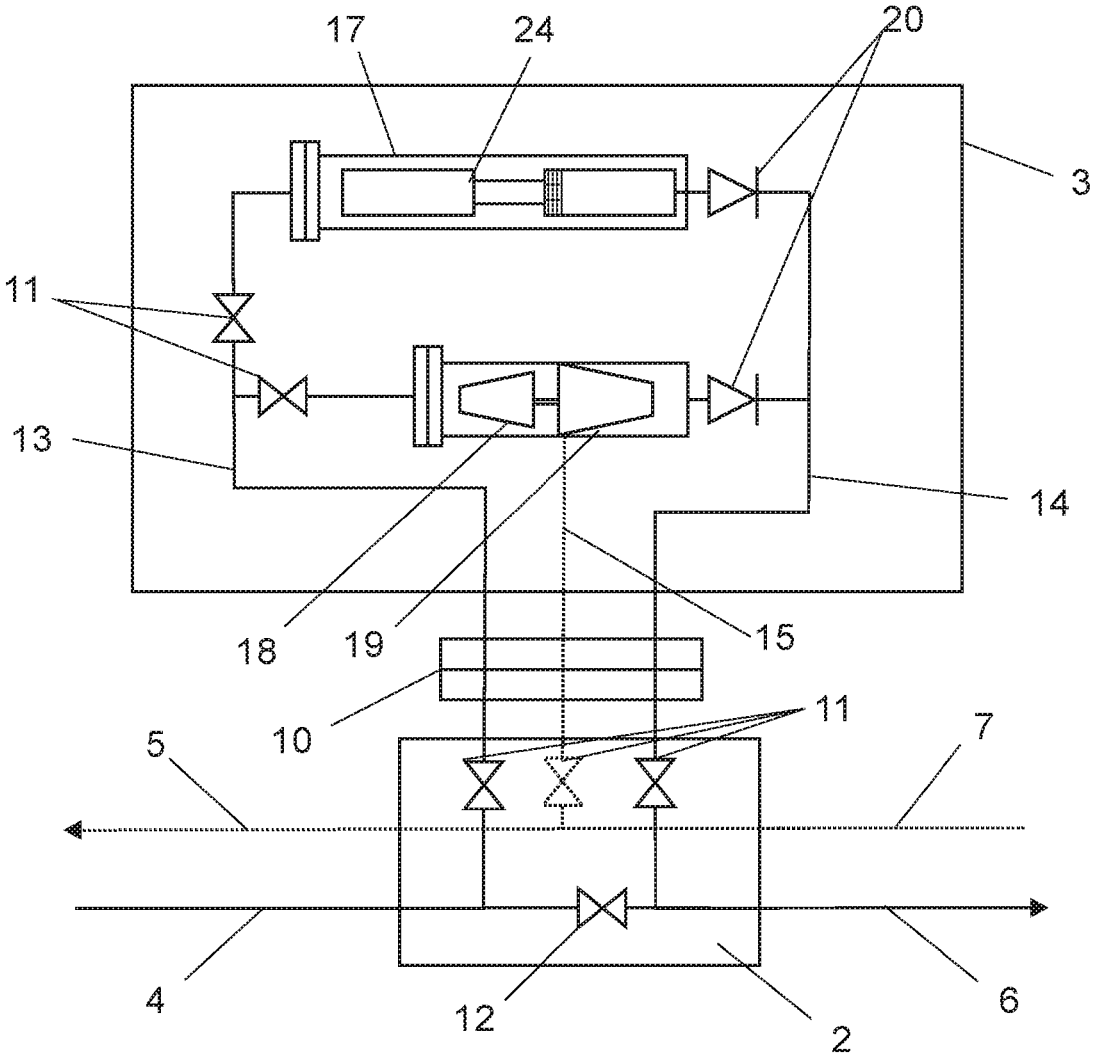
FIG. 8 illustrates schematically a hydraulically driven underwater pumping module according to a sixth embodiment.

FIG. 8 illustrates a sixth embodiment. In this embodiment, the pumping module 3 contains a submerged centrifugal pumps (SCP) set 24 in parallel with an HSP, one pump serving as a reserve for the other, providing great operational flexibility.

The pumping module 3 can be mounted on a compartment that is easily transported, such as a skid (not shown). This means that the pumping module 3 is easily transported between a floating vessel and the sea bed. The pumping module 3 can be replaced and transported by a service vessel (not shown).

Optionally, the replacement of the centrifugal pump 19 or the jet pump 22 from the production unit 8 may involve a flexible pipe unit. Alternatively, the replacement of the centrifugal pump 19 or the jet pump 22 from the production unit 8 may involve reverse operation of fluid circulation.

The blocking valves 11 shown in the figures may be provided in any pipeline of the system of the present invention, such as suction line 13, discharge line 14 and working fluid line 15. Blocking valves 11 allow correct guidance and control of the flow of fluids in the system. In addition, blocking valves 11 allow blocking of the fluid lines in case of disconnection of the pumping module 3 from the subsea base 2.

Optionally, a bypass valve 12 is provided at the boundary between the production line 4 and the riser 6 to allow passage of a pig, as illustrated in FIGS. 3 to 7.

The present disclosure further provides a method for hydraulically driven underwater pumping, said method comprising one or more of the steps of:

(i) driving hydraulically one or more (e.g. two) pumps 19, 22 housed in a pumping module 3 by means of working fluid received from a production unit 8 through a service line 7;

(ii) pumping, by means of the pumping module 3, the fluid produced by a subsea well to the production unit via at least one riser (iii) mixing, in the pumping module 3, the working fluid with the fluid received from at least one subsea producing well 1, and discharging the mixture to the production unit 8 through the at least one riser 6.

Optionally, the working fluid employed in the method of the present invention is a heated working fluid.

Optionally, the method comprises the additional step of heating the mixture of working fluid with production fluid in the pumping module 3 by means of at least one heating element 16.

Accordingly, the pumping system of the present disclosure is based on hydraulic drive, with a jet pump or driven by a turbine. Besides providing energy in the form of pressure, the hydraulic drive supplies energy in the form of heat when the working fluid is pre-heated and mixed with the fluid produced. This temperature rise, combined with the use of a working fluid of low viscosity, for example water, forms a mixture that is far less viscous than the original fluid. This property is extremely advantageous for production of highly viscous heavy crudes. The temperature rise is also beneficial for scenarios of fields in deep waters with high gas-liquid ratio with problems of paraffin deposition due to the Joule-Thomson effect in the decompression of the gas in the riser.

Furthermore, the hydraulically driven pumps, both those of the HSP type driven by high-speed hydraulic turbines and of the jet type, which are significantly shorter than pumps of the SCP type for the same power, make it easier to design pumping modules of reduced size, which are easily installed by smaller vessels, which are commoner, and easier to hire and mobilize.

Moreover, the use of a pumping module 3 driven hydraulically by a working fluid supplied by a service line 7 dispenses with the use of production casings or a power cable inside the riser. This allows passage of a cleaning scraper (pig) by means of the bypass valve 12 installed in the subsea base 2.

In addition, pumps driven hydraulically dispense with all underwater electrical components, components that have contributed greatly to the faults of the SCP systems and other underwater pumps.

Countless variations falling within the scope of protection of the present application are permitted. This reinforces the fact that the present invention is not limited to the particular embodiments described above. As such, modifications of the above-described apparatuses and methods, combinations between different variations as practicable, and variations of aspects of the invention that are obvious to those of skill in the art are intended to be within the spirit and scope of the claims.

The invention claimed is:

1. A hydraulically driven underwater pumping system, comprising:

a pumping module connected to a subsea base via a connector, wherein the subsea base is connected to:

a subsea producing well via a production line that carries a fluid produced by the subsea producing well; and a production unit via a riser and a service line, wherein the hydraulically driven underwater pumping system is configured to receive working fluid from the production unit via the service line; and a pump, located in the pumping module, configured to be driven hydraulically by the working fluid and configured to pump the fluid produced by the subsea producing well to the production unit, the pump coupled to a working fluid line extending through the connector to the subsea base, the working fluid line coupled to the service line, and a suction line of the pump extending through the connector to the subsea base, the suction line coupled to the production line, wherein the hydraulically driven underwater pumping system is further configured to mix the working fluid, after the working fluid has been used to drive the pump, with the fluid produced by the subsea producing well that is pumped to the production unit, wherein the pumping module comprises a heating element connected to a discharge line, wherein the heating element is configured to heat the fluid pumped by the pump to the production unit and preheat the working fluid.

2. The hydraulically driven underwater pumping system according to claim 1, wherein the pump is of the centrifugal type or jet type.

3. The hydraulically driven underwater pumping system according to claim 1, wherein the pumping module comprises the suction line and the discharge line connected to the pump.

4. The hydraulically driven underwater pumping system according to claim 1, further comprising two or more pumps located in the pumping module.

5. The hydraulically driven underwater pumping system according to claim 1, wherein the connector is separable into two parts.

6. The hydraulically driven underwater pumping system according to claim 1, further comprising at least one blocking valve.

7. The hydraulically driven underwater pumping system according to claim 1, wherein the pumping module comprises a gas lift mandrel.

8. The hydraulically driven underwater pumping system according to claim 1, wherein the pumping module does not comprise an electric motor.

9. The hydraulically driven underwater pumping system according to claim 1, wherein the working fluid comprises water.

10. The hydraulically driven underwater pumping system according to claim 1, wherein the riser does not comprise production casings or power cables within the riser.

11. A method for hydraulically driven underwater pumping, the method comprising:

hydraulically driving a pump, housed in a pumping module, with a working fluid received from a production unit via a service line, the pumping module connected to and recoverable from a subsea base, wherein the subsea base is connected to a subsea producing well via a production line and the production unit via a riser and the service line;

pumping, with the pumping module, fluid produced by the subsea producing well to the production unit via a discharge line through the subsea base and the riser;

pre-heating the working fluid in at least one of the production unit or the pumping module;

mixing and discharging, in the pumping module, the working fluid with the fluid produced by the subsea producing well; and heating, with a heating element within the pumping module, the mixture of the working fluid and the fluid produced by the subsea producing well.

12. The method according to claim 11, wherein the pumping module is connected to the subsea base via a connector.

* * * * *